United States Patent [19]

Adamski

[11] 3,972,300

[45] Aug. 3, 1976

[54] SAILING CRAFT

[76] Inventor: Leo J. Adamski, Apt. 1-H, Yip Mansion, Pine Court, 5 Old Peak Road, Hong Kong, Hong Kong

[22] Filed: May 28, 1974

[21] Appl. No.: 473,581

[52] U.S. Cl. ..... 114/39; 114/124; 114/143

[51] Int. Cl.² ..... B63B 39/00; B63H 9/00

[58] Field of Search ..... 114/39, 61, 132, 136, 114/143, 89, 90, 91, 102, 122, 124

[56] References Cited

UNITED STATES PATENTS

| | | | |
|---|---|---|---|
| 236,237 | 1/1881 | McLeod | 114/91 |
| 704,685 | 7/1902 | Jensen | 114/143 |

FOREIGN PATENTS OR APPLICATIONS

| | | | |
|---|---|---|---|
| 185,312 | 12/1905 | Germany | 114/91 |
| 30,537 | 3/1920 | Norway | 114/91 |

*Primary Examiner*—Duane A. Reger
*Assistant Examiner*—Gregory W. O'Connor
*Attorney, Agent, or Firm*—James A. Geppert

[57] ABSTRACT

A sailing craft having a one-piece hull design with a unitary mast, keel and ballast assembly that is mounted on the hull of the craft so that the mast, keel and ballast assembly can rotate independently thereof to permit the hull of the craft to float free of the wind's heeling forces without the adverse effects thereof.

14 Claims, 16 Drawing Figures

99
101
102
103
104
105
106
107
108
109
111
112
113
114
115
116
117
118
119
121
122
123
124
125
126
127
128
129
131
132
133
134
135
136
137
138
139
141
142
143
144
145
15.

SAILING CRAFT

BACKGROUND OF THE INVENTION

Up to the present time, the usual practice in designing sailing craft or sailboats has been to assemble and fix the hull, mast, keel and ballast substantially rigidly together to form an integral unit when in use. The keel is generally heavily weighted and provides a substantial amount of the ballast. With such a design, the lateral wind force acting on the sails causes the entire vessel to heel, with the adverse effects of heeling on the craft including an increase in the wetted surface resulting from an asymmetrical underwater hull shape that tends to cause veering of the craft off-course while increasing the bow wake and resistance to forward movement. This, in turn, increases the tendency of the craft to capsize, as the stability of the boat is decreased.

In the past, various approaches to this problem have been considered, such as the use of a movable ballast shown in Evans U.S. Pat. No. 7,184, or a pivotally mounted mast shown in the Sveinssons U.S. Pat. No. 2,643,628. At best, these solutions have only provided partial answers to the overall problem of heeling by sailing vessels.

SUMMARY OF THE INVENTION

The present invention relates to a sailing craft provided with both a movable or pivotal mast and a movable or pivotal keel and ballast assembly which is applicable to sailing craft of all types and sizes and to both monohulls and multi-hulls. Also, the operating principle of the present invention does not depend on the type of sail, as conventional cloth sails or vanes of stiff material would be equally adaptable to the present invention.

Among the objects of the present invention is the provision of a novel sailing craft where heeling is substantially eliminated in light to moderate winds and is greatly reduced in heavy or severe conditions; thereby making sailing more efficient, easier, more comfortable and safer.

Stability is recognized by designers of sailing craft as the most vital of all design criteria. It represents the ability to carry sail or to provide the power or driving force to propel the boat. A boat sailing on an even keel or at a greatly reduced angle of heel will, in any given wind strength, obtain greater efficiency from its lateral plane and sail area. This invention provides exceptional stability in relation to displacement, enabling the boat to carry a larger than otherwise possible sailplan.

With conventional sailboat designs, stability can only be obtained from buoyancy provided by the hull form, i.e. wide beam and hard bilges, and ballast in the form of an iron or lead keel. Ballast can either be live, such as the crew of the boat, or dead, such as the fixed keel. Live ballast is more efficient because it provides the greatest righting moment for the leads added displacement and does not add to wave-making resistance. Although the present invention does not utilize live or movable ballast, it functions in much the same manner as the ballast is automatically shifted to the windward side of the hull when acted upon by the heeling forces of the wind.

Another object of the present invention is the provision of a sailing craft which provides the advantages of live ballast without the dangers attendant therewith, as the ballast shifts automatically in proportion to the amount of wind force acting on the sails. The force of gravity returns the mast-keel-ballast assembly to the center of the craft when the wind dies down. Also, the present design places no limitation on the amount of ballast that can be used, so it is adaptable to the smallest and largest vessels conceivable.

A further object of the present invention is the provision of a novel sailing craft where the ballast is mounted on or integral with the keel for the craft. To place movable ballast within the hull of a vessel requires a complex mechanism having the inherent danger of mechanical failure and possible capsizing of the vessel. On smaller boats, the crew act as live ballast; however, a sudden wind shift or change in the boat's course can catch the crew off-guard and cause capsizing. The present invention enhances safety of sailing because compensation for any wind force changes occur automatically and offers the advantage of simplicity of design with an extremely remote possibility of mechanical failure. Should the standing rigging fail, the keel and ballast would return to the center of the craft without upsetting its trim.

The present invention also comprehends the provision of a novel sailing craft where the effective beam-length ratio is increased to offer greater stability to the craft when the mast-keel-ballast assembly is in the rotated position. Effectively, almost the entire beam of the boat shifts to the leeward side of the mast, thus utilizing the full buoyancy of the hull for increased stability. Therefore, a boat could be designed, if so desired, using the present principles to make capsizing substantially impossible. This could be done by keeping the heeling moment of wind forces on the sails, with the rotating assembly fully rotated, less than the stabilizing moments resulting from the ballast and hull buoyancy.

With the increased stability provided by this design concept, it becomes possible to carry a greater sail area and thus add to the driving force in all wind conditions. In sailboat design parlance, the aspect ratio is the height of a sail versus its width. A low aspect ratio rig will allow the most sail to be carried for any given heeling moment; however, high aspect ratio rigs are generally more efficient. The present invention provides a sailing craft the benefits of both high and low aspect ratio rigs since the effective vertical height of the sail with respect to the craft on even keel will change with the amount of wind force. As the mast-keel-ballast assembly rotates, its effective aspect ratio with respect to the hull on even keel decreases to provide better efficiency under high wind loads. Simultaneously, rotation of the mast-keel-ballast assembly allows wind to spill off the top of the sail providing an automatic safety feature. In gusty wind conditions, this action would tend to eliminate the danger of knock-downs.

The present design also offers several unique advantages for both racing and cruising sailboats. On racing boats, a hull must have a minimum of resistance to forward motion for maximum speed. In light winds, the wetted area or surface friction play a major role in resistance to forward motion. As speeds increase, resistance increases from surface friction and wave action. To keep this resistance to a minimum, a narrow hull with light displacement is required. The present design makes light displacement and narrow hulls possible because ballast and buoyancy are used in the most efficient manner in providing stability. On a racing boat, the lateral plane must have the minimum area required to prevent excess leeway. With the hull remaining on an even keel, a fixed skeg and the rudder remain essentially vertical and serve as a more efficient aid to preventing leeway, thus allowing the boat to point higher. With the rudder vertical, steering efficiency is maintained and rudder drag, which occurs when a hull is heeled, is eliminated.

Further, on racing boats circular sections are usually utilized because this shape provides the greatest possible buoyancy with the least amount of wetted surface, and the rotating mast-keel-ballast assembly would adapt extremely well on such hulls. This design also concentrates the weight midships to eliminate "hobby-horsing"; an undesirable characteristic of many racing boats. Since the present invention is advantageous for light displacement boats, it is also adaptable to small sailboats designed for planing. Light displacement is essential on planing boats to permit sufficient dynamic lift in relation to the wetted surface.

The present invention is also applicable to cruiser designs and offers advantages in addition to those previously discussed for racing boats. Cruisers are designed with comfort, storage space and safety considerations taking precedence over considerations for speed. The rotating mast-keel-ballast assembly and design can be used on hulls with hard bilges, which is generally the case for cruisers to increase stability and roominess. In light to moderate winds, the invention would eliminate heel on all points of sail, since the hull is independent of the rotating mast-keel-ballast assembly. This would add to the comfort of the occupants, as discomfort caused by heeling is a characteristic of conventional monohulls. Heel would also be greatly minimized in heavy weather conditions.

If the present invention is used on small "day sailor" open-type cruisers, sailing would be more comfortable as there wouldn't be the necessity for the crew to be continually hiking over the side and slacking off on the sheets each time wind strength increases. On larger cruisers, the invention would make sailing easier as it automatically compensates for the effects of wind gusts. It would also lessen the amount of sail reefing and trimming required and make it possible for smaller crews to handle the boat with greater ease. But, on cruisers, the primary advantage of the design is the safety it provides due to automatic self-trimming of the boat in variable wind conditions.

The present invention can be easily adapted to existing sailing craft with minor modification to the hull and standing rigging. Existing masts could be used, but the fore stay and back stay would have to be secured on the rotational or longitudinal centerline of the mast-keel-ballast assembly. The degree of heel allowed for the rotating assembly would vary depending on the overall design aspects of the craft; however, it can be varied to whatever degree the designer considers desirable. The wider the range of permissible rotation, the less is the risk of "knockdown" capsizing due to allowing more wind to spill from the sails. In the event of an accidental grounding, the present invention would assist in refloating the vessel as the rotating assembly could be rotated to lessen draft and free the craft.

The present invention is also adaptable to vessels with more than one mast providing all masts are an integral part of the masts-keel-ballast assembly. The assembly would have to be designed to rotate around the hull in unison leaving the hull free of heeling forces.

Further objects are to provide a construction of maximum simplicity, efficiency, economy and ease of assembly and operation, and such further objects, advantages and capabilities as will later more fully appear and are inherently possessed thereby.

DESCRIPTION OF THE EMBODIMENTS OF THE INVENTION

Figures 1, 2, 3, 4, 5:
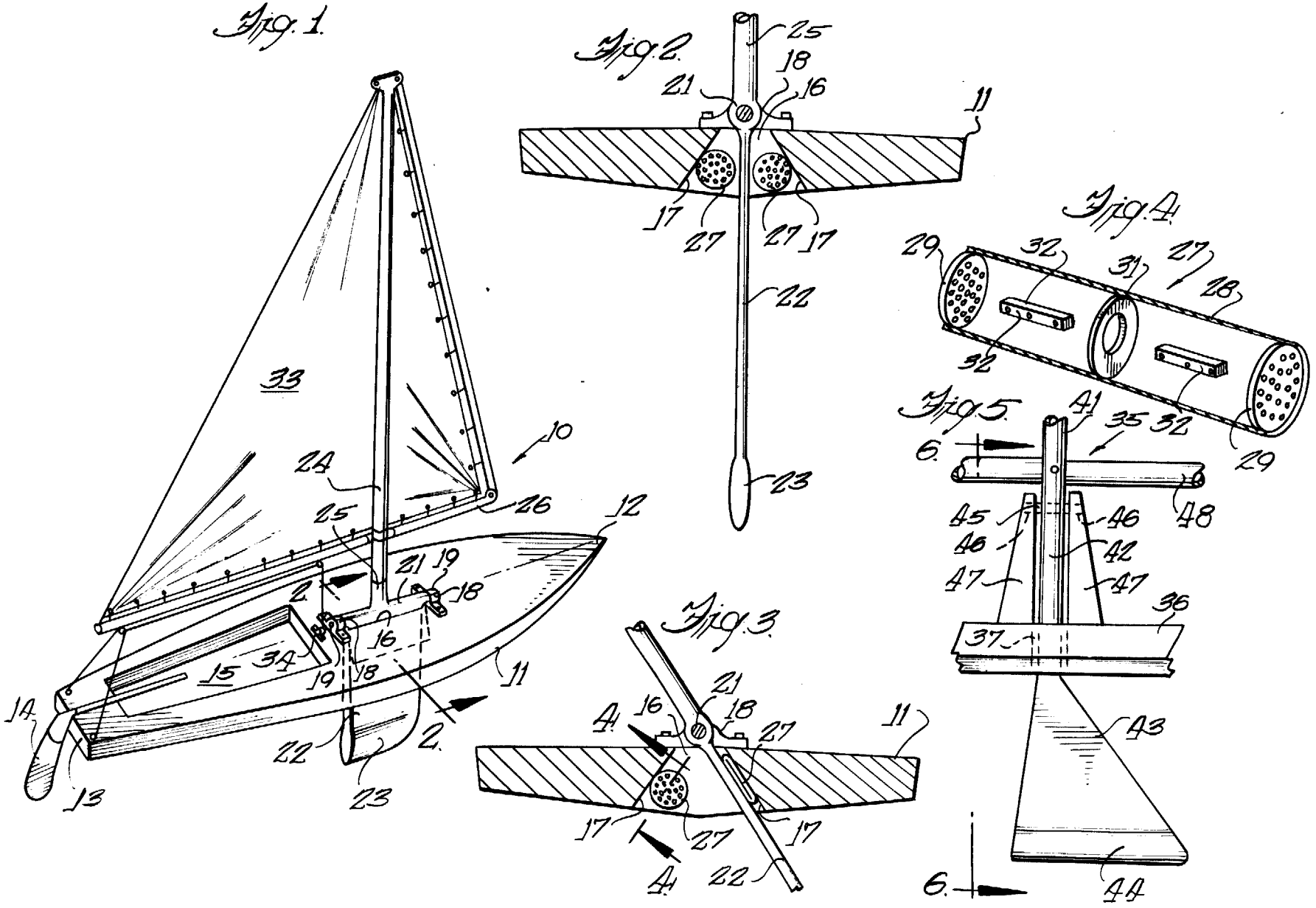
FIG. 1 is a perspective view of one embodiment of the present invention utilizing an integral mast-keel-ballast assembly.
FIG. 2 is a vertical cross sectional view of the hull taken on the line 2—2 of FIG. 1.
FIG. 3 is vertical cross sectional view similar to FIG. 2 but with the mast-keel-ballast assembly rotated in one direction.
FIG. 4 is a perspective view, partly in cross section taken on line 4—4 of FIG. 3, of a cushion or shock absorber.
FIG. 5 is a partial side elevational view of a second embodiment of mast-keel-ballast assembly.

Referring more particularly to the disclosure in the drawings wherein are shown illustrative embodiments of the present invention, FIGS. 1 through 4 disclose one embodiment of sailboat 10 in the form commonly referred to as a "sailing board" or "sailing surfboard", wherein a generally flat hull 11 has a pointed bow 12 and a squared off stern or transom 13 carrying a rudder 14. The hull has a rearwardly located depression or cockpit 15 and a generally rectangular opening 16 is located on the longitudinal centerline of the hull 11; the opening having downwardly and outwardly tapering sides 17, 17. A pair of spaced bearing blocks 18, 18 are secured onto the top surface of the hull 11 and receive the ends 19, 19 of the pivotal portion 21 of the centerboard or keel 22. The ballast 23 is positioned at the lower edge of the keel, and a mast 24 is telescopically received in a socket 25 at the upper edge of the keel.

The boom and standing rigging 26 is operatively secured to the mast 24, and the mast 24, boom and standing rigging 26, the keel 22, and the ballast 23 are pivotally mounted in the bearing blocks 18, 18 to rotate free of the hull 11 around the axis of the pivotal ends 19, 19 until contact is made with the shock absorbers 27 and the stops or sides 17, 17. A shock absorber or cushion 27 is mounted on each side or stop 17 below the waterline and is fabricated of rubber or other suitable resilient material, as more clearly shown in FIG. 4. Each cushion is an elongated resilient tube 28 having perforated ends 29 and a central partition 31 with a central opening, the cushions being secured to the sides 17 through a pair of metal strips 32 and suitable fastening means.

All components of the rotating assembly are preferably formed of a lightweight metal, such as aluminum, except for the ballast 23 which is preferably a heavy material, such as lead, fastened to the keel. The bearing blocks 18 are designed to hinge at one side and be fastened with wing nuts (not shown) to permit removal of the keel-ballast assembly through the top of the hull for transporting. Also, the mast 24 is stepped adjacent its lower end to telescope into the socket 25 to permit disassembly for transporting the boat. No provision has been made for lubricating the bearings as their hinged nature will automatically compensate for any wear that occurs.

The main sheet 33 is cleated on the axis of rotation of the rotating assembly at 34 to minimize the amount of adjustment necessary to keep the sail trim as the mast rotates. The opening 16 in the hull 11 is designed to be water tight. The keel 22 also serves to restrict rapid movemnt of the rotating assembly of the mast 24, keel 22 and ballast 23 from side-to-side as the keel movement is slowed by water pressure resulting from the lateral movement of the keel. The cushion 27 is mounted below the waterline so as to fill with water; the perforated ends 29 allowing escape of water when the keel 22 engages and collapses the cushion and, when the pressure of the keel is relieved, the cushion will automatically refill with water and resume its normal shape due to its resiliency. The degree of rotation of the mast-keel-ballast assembly can be limited either by limiting the width of the opening 16 or by raising or lowering the axis of rotation of the ends 19.

Figures 6, 7, 8, 9, 10, 11:
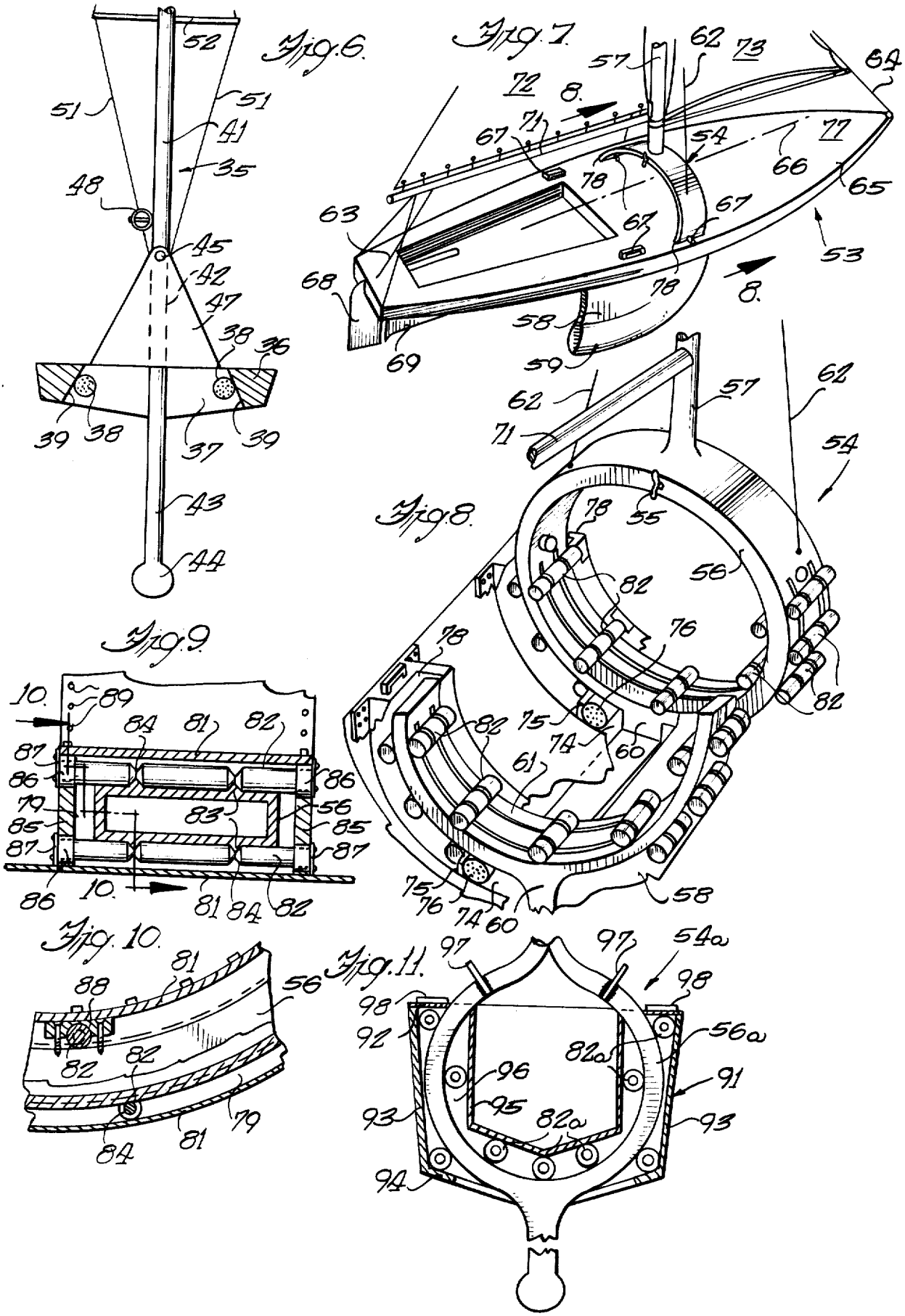
FIG. 6 is a vertical cross sectional view taken on the line 6—6 of FIG. 5.
FIG. 7 is a perspective view of a larger sailboat utilizing a third embodiment of mast-keel-ballast assembly.
FIG. 8 is an enlarged partial perspective view of the mast-keel-ballast assembly of FIG. 7.
FIG. 9 is a cross sectional view taken through the mast-keel-ballast assembly of FIG. 8.
FIG. 10 is a partial vertical cross sectional view taken on the line 10—10 of FIG. 9.
FIG. 11 is a vertical cross sectional view taken through the hull of a modified boat with a fourth embodiment of mast-keel-ballast assembly.

FIGS. 5 and 6 disclose an alternate mounting arrangement for the mast-keel-ballast assembly 35 for small craft requiring additional mast support. In this embodiment, the assembly 35 is mounted on the hull 36 of a boat having a laterally extending opening 37 terminating in cushions or shock absorbers 38 mounted on the ends or stops 39 of the opening. The assembly 35 consisting of a mast 41, pivotal support 42, keel 43 and ballast 44 is pivotally mounted on a hinge or pivot pin 45 located in the support 42 and received in bearing openings 46 in a pair of mast supports 47. A boom 48 and sail are mounted on the mast 41, and further support for the mast consists of fore and aft stays incorporated in the design as well as shrouds 51 and spreaders 52 to provide lateral support for the mast.

FIGS. 7 through 10 illustrate an alternate embodiment of the present invention for a single masted sailing craft 53, such as a smaller racing and cruising craft of up to about 21 feet in length. It has the disadvantage of requiring adjustment of the mainsail trim as the rotating assembly 54 rotates; however, on smaller craft the mainsheet is usually hand-held so this adjustment would pose no difficulty. This size craft provides the advantage of an uncluttered cockpit area and more roominess, but the trim of the jib would not be affected by the rotating assembly since the jib sheet cleat 55 is mounted on the rotating assembly. The rotating assembly includes a circular member 56 having the mast 57 mounted thereon at the upper surface and the keel 58 mounted on the member 56 diametrically opposite the mast; the ballast 59 of iron or lead being provided at the lower edge of the keel. Spaced rearwardly of the circular member 56 is a semi-circular member 61 joined to the circular member 56 by a spaced support 60 at the upper edge of the keel 58. Preferably, the mast, circular and semi-circular members and keel are formed of a light weight metal, such as aluminum.

The mast is supported by shrouds 62 fastened to the circular member 56 and a back stay 63 and a fore stay 64 which are fastened to the hull 65 on the axis of rotation 66 of the rotating assembly 54. Removable pins or blocks 67 are provided for both the circular and semi-circular members to provide a means of securing the rotating assembly to the hull, which would be advantageous when running under "bare poles" or when "hoove to" in storms or at any time the sails are removed. The rudder 68 and skeg 69 are of conventional design firmly affixed to the hull, and a boom 71 is mounted on the mast above the circular member 56 for the mainsail 72, and a jib 73 is suitably mounted.

FIGS. 8 to 10 disclose the mounting means for rotating the members 56 and 61, with FIG. 8 showing a perspective view of the rotating assembly with the hull 65 having a pair of openings or lateral slots 74, 74 in the bottom thereof to receive the spaced extensions 60, 60 on the keel and allow for movement of the keel 58 between the stops 75, 75 and the shock absorbers 76, 76. In this craft, the hull is hollow and has a deck 77 forming the top surface with openings or slots 78 for the members 56, 61. Both the circular member 56 and the semi-circular member 61 are mounted in water-tight compartments 79, 79; each compartment having spaced inner and outer arcuate walls 81, 81 with a plurality of rollers 82 mounted for rotation therein on both the inside and outside of each member. Each member 56, 61 has the lower arcuate portion provided with arcuate ribs 83, 83 keyed to the grooves 84, 84 in the rollers to prevent longitudinal movement of the assembly relative to the hull.

The rollers 82 are formed of a strong, non-corrosive metal, such as monel, supported on the aluminum sides 85 of the compartments 79 in bushing-type aluminum bearings 86 with a water-tight retainer cap 87 holding the bearings and rollers in place. The inside rollers are held in place by a bearing cap 88 to permit shimming and adjustment of the roller 82 against the circular or semi-circular member. The inner wall of the compartment is secured in place by suitable means, such as cap screws 89, so as to be removable to permit assembly and servicing, Suitable grease fittings (not shown) will be used on all bearings to facilitate lubrication thereof.

In use, when coming about or tacking for this craft, the ballast 59 will return the rotating assembly 54 to the vertical position as soon as the lateral wind forces are removed from the sails. When lateral forces are again engaged on the other side of the sails as the craft comes unto the opposite tack, the water forces encountered by the side of the rotating keel 58 will retard movement of the rotating assembly in the opposite direction so that forces imposed on the shock absorber 76 will be minimal. Also, when the rotating assembly 54 contacts a shock absorber, the buoyancy of the hull will offer additional shock absorbing effect, so that the movement of the rotating assembly from one side to the other will take place with a relatively gentle motion, and structural damage caused by violent shock will therefore be avoided. The water-tight compartments 79 will serve to greatly strengthen the structure of the hull midships; the location where structural strength must be greatest in the hull of a boat.

FIG. 11 shows a similar rotating assembly 54a mounted in a hull 91 of a different design from that shown in FIGS. 7 and 8. This hull includes a deck 92, outer sides 93, 93, a bottom 94 and inner sides 95 to form a water-tight compartment 96. The circular member 56*a* is mounted in the compartment to ride on inner and outer rollers 82*a*. A pair of lugs 97, 97 are mounted on the circular member 56*a* and are adapted to engage stops 98, 98 secured on the deck of the hull upon rotation of the assembly.

FIGS. 12 through 15 disclose another embodiment of sailboat 99 which is superior to the previously described embodiments due to the advantage that the trim of the sails is not affected by rotation of the mast-keel-ballast assembly 101. Both the jib sheet cleat 102 and the main sheet cleat 103 are mounted on the rotating assembly 101. The rotating assembly includes a mast 104 mounted on a first or front circular member 105, a rear or second spaced circular member 106, and a keel 107 having a pair of upward projections 108 to be joined to the two circular members. A channel 109 is formed in the hull 111 with an upward arcuate channel extension 112 for both the front and rear members 105, 106. Depending on the hull configuration of the boat, the circular members 106, 106 may be fully exposed on the exterior of the hull or partially enclosed as shown at 113 for the member 106.

Figures 12, 13, 14, 15, 16:
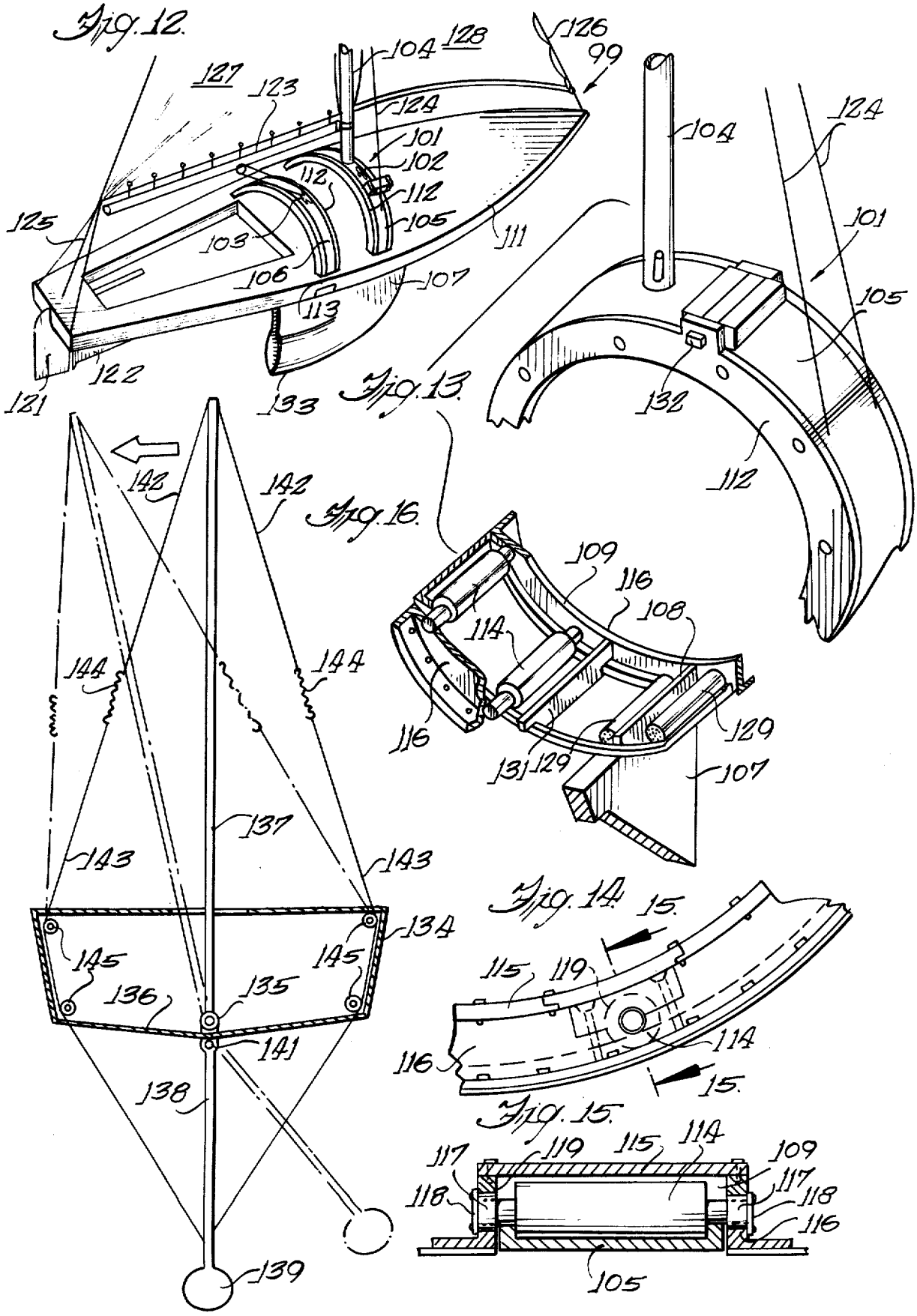
FIG. 12 is a perspective view of a larger sailboat having a fifth embodiment of mast-keel-ballast assembly.
FIG. 13 is an enlarged partially broken away perspective view of the rotary arrangement for the mast-keel-ballast assembly of FIG. 12.
FIG. 14 is a partial side elevational view of a lower portion of the assembly of FIG. 13.
FIG. 15 is a cross sectional view taken on the line 15–15 of FIG. 14.
FIG. 16 is a vertical cross sectional view of a simplified embodiment of the invention utilizing a multi part and mast-keel-ballast assembly.

A plurality of rollers 114 are all mounted in the channel 109 and extension 112, as shown in FIGS. 13 to 15, with each roller being capable of adjustment or removal from inside the hull as the inner surface of the channel is formed of arcuate plates 115 secured to the side pieces 116. Bearings 117 are received in the side pieces 116 with end caps 118 retaining the bearings and rollers in operative position. Also, bearing caps 119 are utilized (see FIG. 14) to allow for shimming or adjustment of an individual roller. The circular members 105, 106 are channel-shaped, as seen in FIG. 15, to fit on the stepped rollers 114 to prevent lateral relative movement.

The boat 99 includes a rudder 121 and skeg 122 at the stern, a boom 123 operatively connected to the mast 104, shrouds 124 attached to the mast and the circular member 106, a back stay 125 and a fore stay 126. A main sail 127 and a jib 128 complete the rigging. This rotating design is most suitable for larger craft, but could be used on a small craft. The shock absorbers 129, 129 are mounted on each side of the keel to cooperate with stops 131, 131 mounted in each channel. A stop pin or block 132 is adapted to be inserted into openings in the channel and circular member 105 to immobilize the rotating assembly. Finally, the ballast 133 is mounted on the lower edge of the keel.

FIG. 16 discloses another embodiment of the present invention utilizing the same principle of operation, but having a slightly different construction. The boat has a hull 134 with a hinge 135 within the bottom 136 of the hull for a rotating mast 137, and a keel 138 having the ballast 139 at the lower end is hinged at 141 on the outer surface of the hull bottom 136. A pair of upper shroud lines 142, 142 and a pair of lower shroud lines 143, 143 are joined, respectively, by a pair of limited expansion springs 144. The lower shroud lines pass over pulleys 145 mounted in the hull 134 and through the bottom 136 to be secured to the keel adjacent the ballast 139. Likewise, the upper shroud lines are secured to the upper end of the mast.

In each of the above embodiments, when sailing in the boat, the wind acting on the mainsail would cause the mast to rotate laterally relative to the hull which, through the rotating assembly or, in FIG. 16, the shroud lines, would cause an opposite proportional movement of the keel and ballast to the windward side of the hull; thus providing self-trimming with the boat hull remaining in a generally vertically oriented position. Under a very strong wind, the mast assembly would be rotated to a maximum degree allowed by the stops on the hull such that slight heeling of the boat hull would result. In the embodiment of FIG. 16, the limited expansion means would provide a difference in the rotation of the mast compared to movement of the keel and ballast; however, the hull would remain trim in light to moderate wind conditions.

I claim:

1. A sailing craft including a one-piece hull design, a unitary mast-keel-ballast assembly rotatably mounted on said hull and including a mast, a depending keel and a ballast positioned on the lower edge of said keel, said mast-keel-ballast assembly having a pivotal axis adjacent the upper surface of the hull, a pair of spaced stops positioned in said hull and cooperating with said mast-keel-ballast assembly to limit the arc of rotation thereof, said hull having an elongated opening extending downward therethrough, said opening having downwardly and outwardly inclined side walls forming said spaced stops, said keel of the assembly extending downwardly through said opening, and a resilient shock absorber positioned on each side wall.

2. A sailing craft as set forth in claim 1, wherein said keel extends upward to a point above said hull, a pair of oppositely extending pivot pins integral with said keel, and a pair of pivot bearings mounted on said hull receiving said pivot pins.

3. A sailing craft as set forth in claim 1, including a pair of mast supports mounted on said hull, and said mast having a hinge pin spaced above said hull, said supports having bearings receiving the ends of the hinge pin.

4. A sailing craft including a one-piece hull design, a unitary mast-keel-ballast assembly rotatably mounted on said hull and including a mast, a depending keel, and a ballast positioned on the lower edge of said keel, said mast-keel-ballast assembly having a pivotal axis adjacent the upper surface of the hull, a pair of spaced stops positioned in said hull and cooperating with said mast-keel-ballast assembly to limit the arc of rotation thereof, at least one generally circular member rigidly connecting the mast and keel together, and a plurality of rollers positioned in the hull engaging at least one surface of and guiding rotary movement of the generally circular member.

5. A sailing craft as set forth in claim 4, including a circular member connecting said mast and keel and a semi-circular member spaced rearwardly of the circular member and connected to said keel, said rollers being positioned in said hull on both surfaces of the circular and semi-circular members.

6. A sailing craft as set forth in claim 5, wherein said hull has a pair of lateral slots substantially aligned with said circular and semi-circular members, said keel having spaced extensions projecting through said slots and connected to said circular and semi-circular members, said slots allowing limited rotation of said keel, a pair of spaced stops at the opposite ends of each slot, and a shock absorber on each stop.

7. A sailing craft as set forth in claim 5, including arcuate compartments in the hull receiving the circular and semi-circular members, said rollers being positioned in said compartments to guide the members.

8. A sailing craft as set forth in claim 7, wherein each roller has at least one annular groove in its surface, and each member has at least one arcuate rib formed on each surface corresponding to the grooves in said rollers, being positioned on the inner and outer surfaces of each member.

9. A sailing craft as set forth in claim 4, in which a single generally circular member is mounted in said hull, inwardly spaced walls forming with the hull a water-tight compartment therebetween, said rollers being mounted in said hull compartment engaging both the inner and outer surfaces of the circular member, a deck on the hull, a pair of stops mounted on said circular member normally spaced above the hull so as to limit rotary movement of said assembly by engaging said deck, said hull having a transversely extending slot in the bottom surface to allow rotary movement of said assembly.

10. A sailing craft as set forth in claim 4, including a pair of axially spaced generally circular members connecting said mast and keel together, and an arcuate guide channel in said hull for each circular member, said rollers being positioned to engage only the interior surface of each circular member.

11. A sailing craft as set forth in claim 10, wherein each guide channel is formed in the exterior surface of the hull, and an extension of each guide channel above the hull to form a complete circle, said rollers being positioned in said extensions.

12. A sailing craft as set forth in claim 11, in which each circular member has a generally channel shape with outer flanges located over the end surfaces of said rollers.

13. A sailing craft as set forth in claim 12, including a pair of spaced stops in each channel to limit rotary movement of the keel, and a shock absorber positioned on each side of the keel and adapted to cooperate with a respective stop.

14. A sailing craft including a hull, a mast and a keel connected together as a unitary assembly rotatably mounted on and movable laterally relative to the hull so that movement of said mast in one direction will result in a proportionate movement of the keel in the opposite direction, a ballast positioned on the lower edge of the keel, the pivotal axis of said mast-keel assembly being adjacent the upper surface of the hull, a pair of axially spaced generally circular members, one of which connects said mast and keel together, an arcuate guide channel in said hull for each circular member, a plurality of rollers mounted in the hull engaging only the interior surface of each circular member to allow and guide rotary movement of the mast-keel assembly, a pair of stops in each channel to limit rotary movement of the keel, and a shock absorber located on each side of said keel and adapted to cooperate with a respective stop.

* * * * *